US011051621B2

(12) United States Patent
Bieling et al.

(10) Patent No.: US 11,051,621 B2
(45) Date of Patent: Jul. 6, 2021

(54) ACTUATOR AND BACKREST DEVICE, AND PIECE OF SEATING FURNITURE HAVING ONE SUCH

(71) Applicant: VITRA PATENTE AG, Birsfelden (CH)

(72) Inventors: Thomas Bieling, Rheinfelden (DE); Thomas Schneider, Schwörstadt (DE)

(73) Assignee: VITRA PATENTE AG, Birsfelden (CH)

( * ) Notice: Subject to any disclaimer, the term of this patent is extended or adjusted under 35 U.S.C. 154(b) by 184 days.

(21) Appl. No.: 16/342,938

(22) PCT Filed: Oct. 17, 2017

(86) PCT No.: PCT/EP2017/076440
§ 371 (c)(1),
(2) Date: Dec. 31, 2019

(87) PCT Pub. No.: WO2018/073225
PCT Pub. Date: Apr. 26, 2018

(65) Prior Publication Data

US 2020/0205572 A1 Jul. 2, 2020

(30) Foreign Application Priority Data

Oct. 18, 2016 (EP) ..... 16194439

(51) Int. Cl.
*A47C 7/40* (2006.01)

(52) U.S. Cl.
CPC ..... *A47C 7/402* (2013.01)

(58) Field of Classification Search
CPC ..... A47C 7/402
(Continued)

(56) References Cited

U.S. PATENT DOCUMENTS 6,343,840 B1 * 2/2002 Chuang ..... A47C 1/0305 297/353
2003/0214166 A1 * 11/2003 Schambre ..... B60N 2/68 297/353

(Continued)

FOREIGN PATENT DOCUMENTS

TW M321735 U 11/2007

OTHER PUBLICATIONS

International Search Report dated Dec. 15, 2107 in corresponding International Patent Application No. PCT/EP2017/076440.

*Primary Examiner* — Anthony D Barfield
(74) *Attorney, Agent, or Firm* — Medler Ferro Woodhouse & Mills PLLC

(57) ABSTRACT

An actuator device is disclosed that permits a first element to be moved linearly, in particular quasi-vertically, relative to a second element. The actuator device may be provided, in particular, for a vertical movement of a backrest, for example in a piece of seating furniture such as an office chair. The actuator device includes a displacement profile within a guide housing and a locking element. The displacement profile includes a latching row and the locking element is configured for engagement with the latching row. In a latching position, the locking element is resiliently rotated into the latching row of the displacement profile, and rotates back and forth when the displacement profile moves in a first direction with respect to the guide housing. In a release position, the locking element is rotated into a retaining position until it is disengaged from the latching row of the displacement profile.

17 Claims, 3 Drawing Sheets

(58) Field of Classification Search
USPC ..... 297/353
See application file for complete search history.

(56) References Cited

U.S. PATENT DOCUMENTS

| | | | | |
|---|---|---|---|---|
| 2011/0215623 | A1 | 9/2011 | Tsai | |
| 2012/0193962 | A1* | 8/2012 | Chen | A47C 7/405 297/353 |

* cited by examiner

ACTUATOR AND BACKREST DEVICE, AND PIECE OF SEATING FURNITURE HAVING ONE SUCH

TECHNICAL FIELD

The invention relates to an actuator device according to the preamble of independent claim 1. With such an actuator device, a first element may be moved linearly, in particular quasi-vertically, relative to a second element over a predefined displacement path. This may be provided in particular for a vertical movement of a backrest, for example in a piece of seating furniture, in particular an office chair.

PRIOR ART

Many pieces of seating furniture, in particular office chairs, are currently equipped with backrests that are provided to allow ergonomic seating. For this purpose, for example the backrests are connected to a chair base or a seat via a backrest carrier. The backrest carrier may thus allow on the one hand a resilient downward movement of the backrest, and on the other hand, a resilient movement in a lateral direction or a rotating movement to a certain extent.

Backrests are often height-adjustable to allow adaptation to a user. For example, EP 2 721 962 A1 describes a backrest in which a baseplate of a backrest is height-adjustably mounted on two webs of a backrest carrier that is connected to a seat. A dorsokinetic bearing that allows rotational movements is situated on the baseplate. For adjusting the height, the webs are each equipped with a row of latching structures. A locking lever, a button supported by springs, and a cover are mounted on the baseplate. The locking lever is designed to engage with the latching structures of the webs. The locking lever is disengaged from the latching structures by pressing the button upwardly against the elastic force. In this position, the baseplate may be moved upwardly and downwardly along the webs. As soon as the button is released, the springs press it downwardly, and the locking lever, possibly at another location, re-engages with the latching structures of the webs. In this position, the baseplate is once again fixedly connected to the webs, and thus, to the backrest carrier.

Another device for adjusting the height of a backrest without a button or some other triggering means to be manually actuated is described in DE 10 2009 014 777 A1. An adjustment device is proposed therein, having a sliding element that is situated in a housing-like guide rail. The sliding element includes latching, and is movable along its longitudinal axis relative to the guide rail. The adjustment device also includes a locking element in the form of a leaf spring having a latching tab that cooperates with the latching. When the sliding element is pulled out of the guide rail and along the latching, after a certain point the leaf spring is entrained by the sliding element and lifted onto a support surface. The leaf spring is thereby bent, and the latching tab is lifted out of the latching. The sliding element may now be moved opposite the latching until it again entrains the leaf spring in the other direction and brings it down from the support surface. The latching tab then re-engages with the latching.

A disadvantage of devices for adjusting the height of backrests in the manner described above is that typically a relatively large number of components or components that are difficult to install are present. This may make the manufacture of the chair backs or the chairs relatively complex and expensive. Furthermore, such devices are also comparatively susceptible to wear, which makes regular maintenance necessary.

The object of the present invention, therefore, is to propose an actuator device or a system for adjusting the height of a backrest in a piece of seating furniture, that can be manufactured and maintained relatively easily and that is relatively robust and durable.

DESCRIPTION OF THE INVENTION

The object is achieved according to the invention by an actuator device as defined in independent claim 1, a backrest device as defined in independent claim 14, and a chair as defined in independent claim 22. Advantageous embodiment variants of the invention result from the dependent claims.

The essence of the invention is as follows: An actuator device for the guided linear and in particular quasi-vertical movement of a first element relative to a second element over a predefined displacement path includes a guide housing, a displacement profile that is situated in the guide housing and has a longitudinal axis, and a locking element. The displacement profile or the guide housing has a latching row that extends along the longitudinal axis and has a plurality of latching ramps. The locking element is resiliently supported, and in a latching position engages with the latching row of the displacement profile so that the displacement profile is movable in a stepwise manner in a first direction along the longitudinal axis with respect to the guide housing, and a movement in a second direction, opposite the first direction, is blocked by the locking element striking against one of the latching ramps. In a release position, the locking element is held in a disengaged state from the latching row of the displacement profile or the guide housing, so that the displacement profile is freely movable in the first direction and in the second direction along the longitudinal axis with respect to the guide housing.

The locking element is provided to be supported so that it is rotatable about a rotational axis, wherein in the latching position it is resiliently rotated about the rotational axis into the latching row of the displacement profile or the guide housing, and preferably rotates back and forth about the rotational axis when the displacement profile moves in the first direction along the longitudinal axis with respect to the guide housing. In the release position, the locking element is held, while being rotated about the rotational axis into a retaining position, until it is disengaged from the latching row of the displacement profile or the guide housing.

The term "housing" in conjunction with the guide housing may refer to an element in or on which the displacement profile is situated, or that supports the displacement profile. The guide housing may have a design that is completely open or partially open, for example in the form of a shell. In particular, the guide housing may have openings that allow access to the displacement profile. The guide housing may also at least partially enclose the displacement profile.

The term "profile" in conjunction with the displacement profile may refer in particular to a longitudinally extending component. The profile may have a quasi-bar shape or the like. The longitudinal axis of the profile corresponds to the axis in which it extends lengthwise.

The term "ramp" as used herein may refer to an ascending surface. Ramps may ascend, for example, along the longitudinal axis of the displacement profile and thus form an acute angle with respect to the longitudinal axis. The latching ramps of the latching row of the displacement profile or the guide housing may each include a ramp section on which they ascend along the longitudinal axis in the first direction, and a stop section on which they abruptly descend with respect to the longitudinal axis and thus form a stop with regard to a movement in the second direction. For example, the stop section may be situated at greater or less than a right angle with respect to the longitudinal axis.

According to the invention, the locking element is supported so that it is rotatable about the rotational axis. The rotational axis is preferably oriented transversely and in particular essentially at a right angle with respect to the longitudinal axis. Such a pivot bearing may have a relatively simple design, and may be operated in a way that protects the materials. In order for the locking element to be able to resiliently rotate about the rotational axis in the latching position, it is advantageously resiliently supported so that it is pretensioned in the direction of the latching row of the displacement profile or the guide housing. A separate spring may be provided for this purpose. However, the locking element itself advantageously includes a spring section that pretensions the locking element in the direction of the latching row. In the latching position the spring section may rest against a guide housing wall, for example, so that the spring section is wedged between the guide housing and the displacement profile, and the locking element presses in the direction of the latching row.

The actuator device according to the invention allows reliable latched adjustment of the first element relative to the second element, with a relatively simple design. The actuator device may be used in many different applications in which a first and a second element are moved to a predefined extent, in particular vertically, relative to one another. For example, the actuator device may be used in furniture, for example for adjusting the height of a head part of a bed frame or for adjusting the height of an armrest in a piece of seating furniture. It may be used in a particularly advantageous manner for adjusting the height of a backrest of a chair. The actuator device according to the invention allows the height adjustment to be made without tools and without any control unit such as a button or a handle. In addition, it may be easily designed and installed using relatively few components. The actuator device may be relatively robust and durable due to the simple, stable design. In addition, maintenance effort may be kept low.

The actuator device may be used in particular for adjusting the height of the first element relative to the second element. During such a vertical displacement of the displacement profile relative to the guide housing, the force of gravity may in each case move the displacement profile downwardly so that the locking element rests against one of the latching ramps of the latching structure. In particular, the actuator device may be installed for adjusting the height of a backrest in a chair or piece of seating furniture.

The latching row is preferably provided on the displacement profile, and the locking element is rotatably supported on the guide housing. Such a configuration of the locking element and the latching row allows an efficient, stable design of the actuator device. In particular, the movable locking element may thus be mounted on the housing, and the latching row may be mounted on the displacement profile that is movable in the guide housing.

The guide housing preferably has a retaining structure that holds the locking element when it is rotated into the retaining position. The retaining structure of the guide housing preferably includes an opening in which the locking element rests when it is rotated into the retaining position, the locking element resting against an edge of the opening of the guide housing in a form-fit or frictionally engaged manner. The opening may be a through opening or a recess provided in the guide housing. The opening may be formed in particular in a guide housing wall. The edge of the opening may be adapted in shape to the locking element in such a way that reliable frictional engagement may be ensured. For example, the edge of the opening may have an indentation that is congruently shaped with respect to a protrusion of the locking element. The locking element preferably has a clamping tab that cooperates with the retaining structure of the guide housing in the retaining position of the locking element. Such a configuration of the actuator device with a retaining structure allows the locking element to be reliably held in the release position of the actuator device, without the need to provide additional components.

The actuator device preferably has a deactivation structure that rotates the locking element into the retaining position when the displacement profile is moved in the first direction toward one end of the predefined displacement path, along the longitudinal axis with respect to the guide housing. Such a deactivation structure allows the locking element to be automatically rotated into the retaining position when the displacement profile is moved far enough. In one application of the actuator device, it may easily be put in the release position by moving the displacement profile and the guide housing far enough relative to one another in the first direction. This allows convenient, simple, and reliable operation in many applications.

The deactivation structure preferably has a deactivation ramp that is integrally formed on the displacement profile and along which the locking element may be pressed into the retaining position. The deactivation ramp is preferably situated adjacent to the latching row in the direction of the longitudinal axis. With such a deactivation ramp, the locking element may be easily and reliably rotated into the retaining position, without the need to provide additional components.

The actuator device preferably has an activation structure that rotates the locking element out of the retaining position when the displacement profile is moved in the second direction toward one end of the predefined displacement path, along the longitudinal axis with respect to the guide housing. Such an activation structure allows the locking element to be automatically rotated out of the retaining position when the displacement profile is moved far enough in the second direction. In one application, the actuator device may thus be easily put in the latching position by moving the displacement profile and the guide housing far enough relative to one another in the second direction. This allows convenient, simple, and reliable operation in many applications.

The activation structure preferably has an activation ramp that is integrally formed on the displacement profile and along which the locking element may be pressed into the retaining position. The activation ramp is preferably situated adjacent to the edge of the opening. With such an activation ramp, the locking element may be easily and reliably rotated out of the retaining position, without the need to provide additional components.

The guide housing preferably has an essentially circular cylindrical outer circumference. Such a guide housing may allow the actuator device to have a simple design. In addition, it may allow rotation to a certain extent of an element that is connected to it. For example, for an actuator device that is used to adjust the height of a backrest, such a guide housing may allow the backrest to be laterally tiltable to a certain extent with respect to the actuator device, and thus with respect to the backrest carrier. This may be important for an ergonomic backrest.

The actuator device preferably includes an axial rod that is connected to the guide housing, the locking element being supported on the axial rod so that the axial rod forms the rotational axis of the locking element. The axial rod may be integrally formed in the locking element, or may be provided as a separate component that passes through a corresponding borehole in the locking element. Such an axial rod allows simple mounting of the locking element in the guide housing in a rotatable position. Such an axial rod also allows reliable, stable rotation of the locking element.

Another aspect of the invention relates to a backrest device for a piece of seating furniture, in particular an office chair. The backrest device includes a backrest, a backrest carrier, and an actuator device as described above, wherein the backrest is mounted on the guide housing of the actuator device, and the backrest carrier is mounted on the displacement profile of the actuator device. The backrest and the backrest carrier may each be mounted on the guide housing or on the displacement profile directly, or indirectly via other components. The backrest may thus be the first element that is connected to the actuator device, and the backrest carrier may be the second element that is connected to the actuator device, the first and second elements being movable linearly relative to one another.

The actuator device of the backrest device preferably includes a guide housing having an essentially circular cylindrical outer circumference, and the backrest of the backrest device includes a bracket having an inner surface whose shape essentially corresponds to the outer circumference of the guide housing of the actuator device. The actuator device is preferably situated in the bracket of the backrest, so that the bracket of the backrest is rotatable about the guide housing of the actuator device. Such a rotatable connection between the backrest and the actuator device allows lateral flexibility, which is not easily possible with a fixed connection. Such a backrest device, with a relatively simple design, may thus allow preferred flexibility in the backrest area of a chair. The chair may thus have a comfortable, ergonomic design.

The bracket of the backrest preferably includes a casing that is mounted so as to be nonrotatable with respect to the actuator device, and a rotary cylinder situated between the casing and the actuator device, the rotary cylinder being rotatable with respect to the casing and about the guide housing of the actuator device. The rotatable connection may be efficiently and stably achieved in this way.

The backrest preferably has a further bracket and a support section that laterally merges into each of the two brackets, and a further actuator device, situated in the further bracket of the backrest, whose guide housing is mounted on the backrest, and whose displacement profile is mounted on the backrest carrier. Such a support section that is held on two sides allows comfortable support of the back of a user of the chair, with the stated lateral flexion.

The bracket of the backrest preferably has a further rotary cylinder, the two rotary cylinders being fixedly connected to the support section. The support section and the rotary cylinder may also be manufactured in one piece from the same material. The further bracket preferably includes a further casing that is mounted so as to be nonrotatable with respect to the further actuator device, the further rotary cylinder being situated between the casing and the actuator device, and the further rotary cylinder being rotatable with respect to the further casing and about the guide housing of the further actuator device. Such casings allow a stable, flexible design.

The casing and the further casing preferably each include an opening through which the rotary cylinder or the further rotary cylinder is connected to the support section. The openings in the casing and in the further casing preferably specify an extent to which the rotary cylinder or the further rotary cylinder is rotatable about the guide housing of the actuator device or the guide housing of the further actuator device. Guided rotation over a sufficient circumference may thus be implemented in a stable manner.

A further aspect of the invention relates to a chair or a piece of seating furniture, in particular an office chair, having a seat support, a seat that is mounted on the seat support, and a backrest device as described above, wherein the backrest carrier is situated on the seat support.

Such a backrest device and such a chair allow the effects and advantages, described above in conjunction with the actuator device and its preferred embodiments, to be efficiently achieved.

BRIEF DESCRIPTION OF THE DRAWINGS

Further advantageous embodiments of the invention result from the following description of exemplary embodiments of the invention, with the aid of the schematic drawings. In particular, the actuator device according to the invention and the backrest device according to the invention are explained in greater detail based on exemplary embodiments, with reference to the appended drawings, which show the following.

APPROACH(ES) TO CARRYING OUT THE INVENTION

Figure 1:
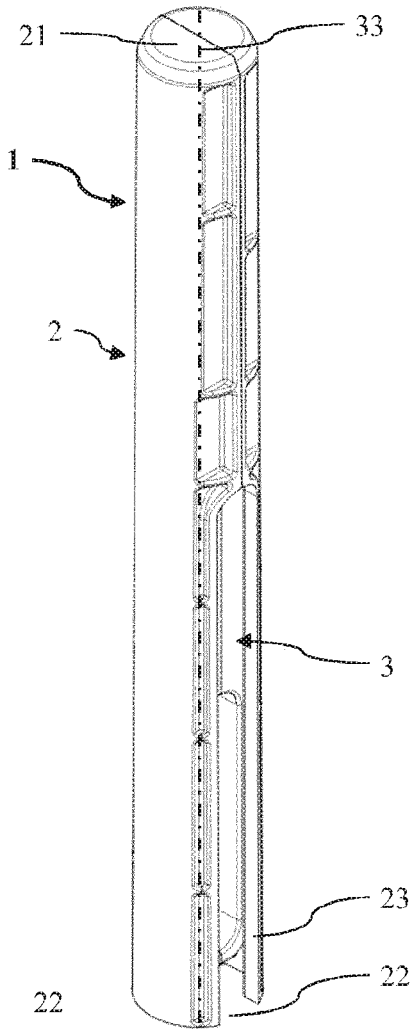
FIG. 1 shows a perspective view of one exemplary embodiment of an actuator device according to the invention.

Certain expressions are used in the following description for practical reasons, and are not to be construed as limiting. The words "right," "left," "bottom," and "top" denote directions in the drawings to which reference is made. The expressions "inwardly," "outwardly," "below," "above," "left," "right," or the like are used to describe the arrangement of denoted parts relative to one another, the movement of denoted parts relative to one another, and the directions toward or away from the geometric midpoint in the invention as well as designated parts thereof, as illustrated in the figures. These spatial relative indications also encompass other positions and orientations than illustrated in the figures. For example, when a part illustrated in the figures is turned upside down, elements or features that are described as "below" are then "above." The terminology includes the words expressly mentioned above, derivations of same, and words of similar meaning.

To avoid repetitions in the figures and the associated description of the various aspects and exemplary embodiments, certain features are to be understood collectively for various aspects and exemplary embodiments. The omission of an aspect in the description or in a figure does not imply that this aspect is absent in the associated exemplary embodiment. Rather, such an omission may serve to improve clarity and prevent repetitions. In this regard, the following applies for the entire further description: If reference numerals are contained in a figure for the purpose of graphical clarity, but are not mentioned in the directly corresponding text in the description, reference should be made to their explanation in the preceding description of the figures. Furthermore, if reference numerals are mentioned in the text in the description that directly corresponds to a figure, but are not contained in the associated figure, reference should be made to the preceding and subsequent figures. Similar reference numerals in two or more figures stand for similar or identical elements.

FIG. 1 shows one exemplary embodiment of an actuator device 1 according to the invention, having a guide housing 2 and a displacement profile 3. The guide housing 2 includes two interconnected housing halves, which together have an essentially hollow cylindrical design. In particular, the guide housing 2 has a quasi-circular cylindrical outer surface. At the top the guide housing 2 is designed with a closed end side 21, and at the bottom, with an open end side 22. Starting from the bottom open end side 22, a longitudinal slot 23 is formed in the guide housing 2 up to approximately one-half the height of the guide housing 2. An inner space of the guide housing 2 in which the displacement profile 3 is vertically situated is accessible through the slot 23. Accordingly, a longitudinal axis 33 of the displacement profile 3 is vertically oriented.

Figure 2:
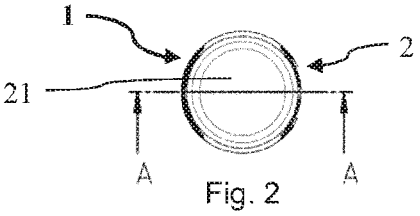
FIG. 2 shows a view of the actuator device from FIG. 1.

FIG. 2 illustrates the actuator device 1 from above. It is apparent that the closed end side 21 has a circular design.

Figure 3:
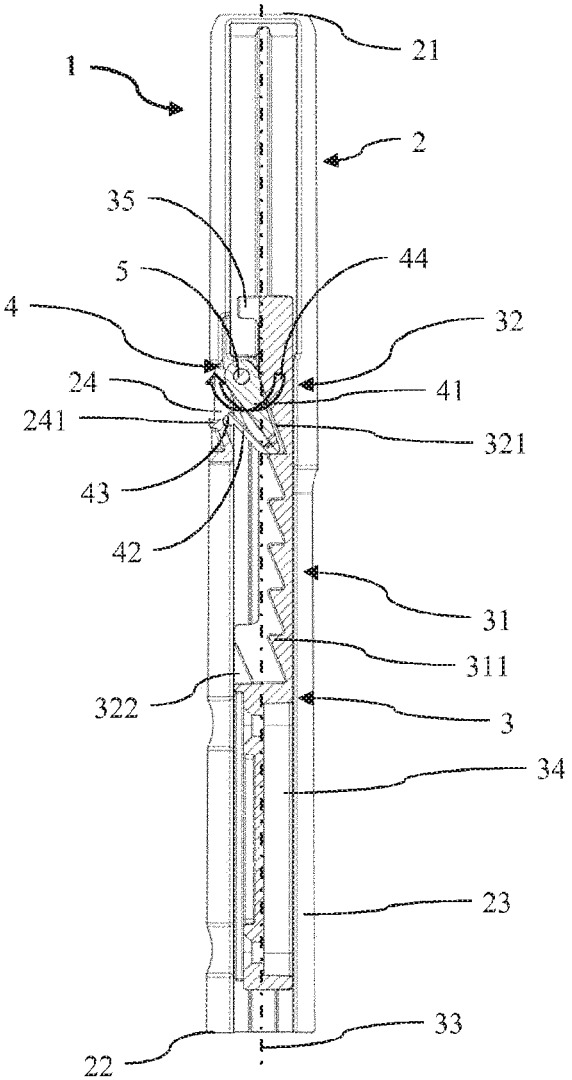
FIG. 3 shows a cross-sectional view of the actuator device from FIG. 1 along the line A-A from FIG. 2 during deactivation from a latching position into a release position.

FIG. 3 shows the actuator device 1 in a cross-sectional view. It is apparent that the displacement profile 3 is situated in the inner space of the guide housing 2. The displacement profile 3 includes a mounting section 34 adjacent to the slot 23 of the guide housing 2, and a ramp row 31 as a latching row. The mounting section 34 is accessible from outside the guide housing 2 through the slot 23. The ramp row 31 includes five identical, adjacently situated ramps 311 along the longitudinal axis 33. Each latching ramp 311 has a ramp section that ascends to the left along the longitudinal axis 33, and at the end of the ramp section has a stop section that extends at a right angle with respect to the longitudinal axis.

A deactivation ramp 321 of a (de)activation structure 32 adjoins the ramp row 31 above the uppermost latching ramp 311. The deactivation ramp 321 includes a ramp section having a shape that is analogous to the ramp sections of the latching ramps 311 of the ramp row 31, but that extends farther to the left. At the upper end of the ramp section, the deactivation ramp 321 merges into an abutment section that extends in parallel to the longitudinal axis. The displacement profile 3 ends in a stop 35 above the abutment section of the deactivation ramp 321.

The guide housing 2 is provided with an opening 24 on the left side. Adjacent to the opening 24, a locking element 4 is supported on the guide housing via an axial rod 5 that forms a rotational axis. The locking element 4 includes a base section 41 having a wedge-shaped cross section, and from the pointed end of which a spring tongue 42 extends upwardly at the left of the base section 41. A clamping tab 43 is formed on the locking element 4 at the upper end of the spring tongue 42. The base section 41 of the locking element 4 is also provided with a borehole through which the axial rod 5 extends.

The opening 24 of the guide housing 2 includes a lower edge 241 having a beveled area and a tab receptacle. The beveled area is approximately parallel to the ramp sections of the latching ramps 311. The shape of the tab receptacle is congruent with the clamping tab 43. At the same height as the ramp section of the lowermost latching ramp 311 of the ramp row 31, the displacement profile 3 includes two activation ramps 322 of the (de)activation structure 32. The activation ramps 322 are approximately parallel to the ramp section of the lowermost latching ramp 311 of the ramp row 31, and are situated opposite same.

In the position shown in FIG. 3, the base section 41 of the locking element 4 rests against the ramp section of the deactivation ramp 321. A downward movement of the displacement profile 3 causes the locking element 4 to rotate in a deactivation rotation 44, against an elastic force of the spring tongue 42, in the clockwise direction, or outwardly and to the left, about the rotational axis. The clamping tab 43 of the locking element 4 hereby migrates upwardly along the beveled area of the edge 241 of the opening 24.

Figure 4:
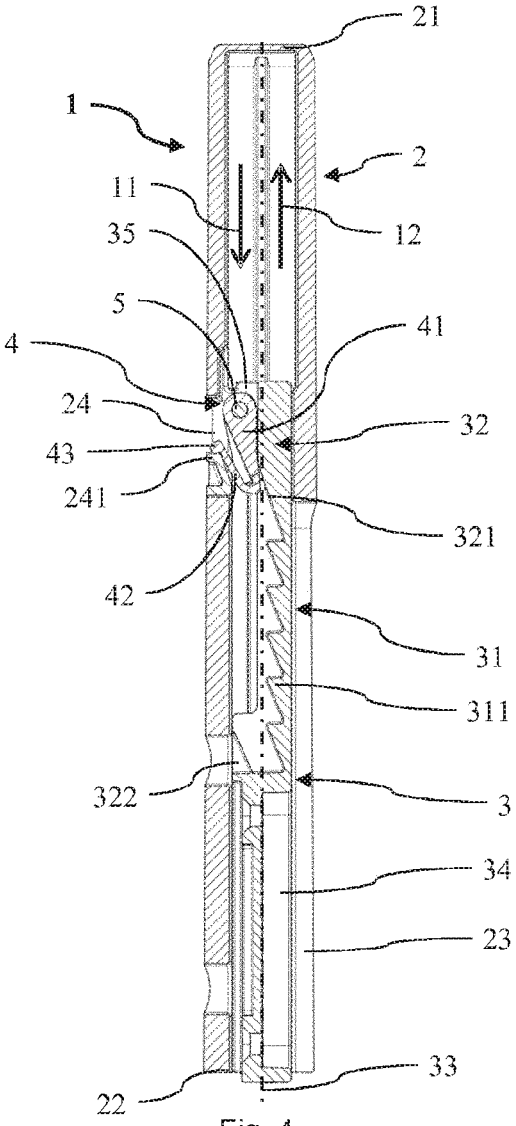
FIG. 4 shows a cross-sectional view of the actuator device from FIG. 1 in the release position.

FIG. 4 shows the actuator device 1 with the locking element 4 pushed onto the abutment section of the deactivation ramp 321. The locking element 4 rests against the stop 35, and thus cannot be moved further upwardly along the displacement profile. A first end of a displacement path of the actuator device 1 is thus defined. As the result of the locking element 4 rotating until it rests on the abutment section of the deactivation ramp 321, the spring tongue 42 rotates as well, and the clamping tab 43 springs behind the edge 241 of the opening 24 of the guide housing 2. The clamping tab 43 is situated at the edge 241 of the opening 24 and is held there by frictional engagement. The locking element 4 is thus rotated into a retaining position, and is no longer situated in the effective range of the ramp row 31. The displacement profile 3 may thus be moved downwardly in a first direction 11, and upwardly in a second direction 12, relative to the guide housing 2. The actuator device 1 is in its release position.

Figure 5:
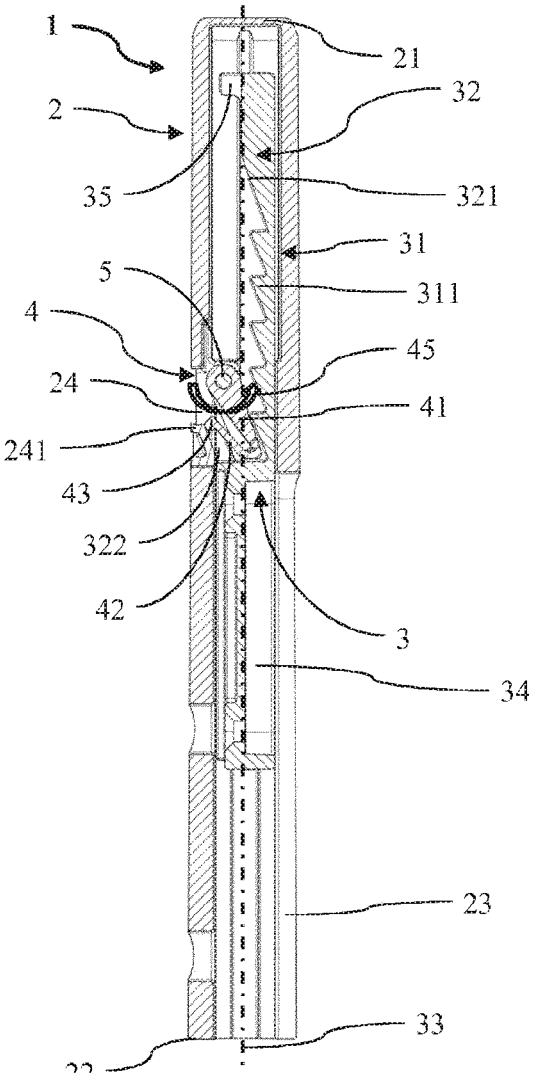
FIG. 5 shows a cross-sectional view of the actuator device from FIG. 1 during a change from the release position into the latching position.

FIG. 5 shows the actuator device 1 during reactivation of the locking element 4. The displacement profile 3 is moved all the way to the top in the second direction 12 relative to the guide housing, until the activation ramp 322 contacts the spring tongue 42 of the locking element 4 and pushes it to the right. As a result, the locking element 4 is rotated counterclockwise in an activation rotation 45 about the rotational axis, the clamping tab 43 springs from the edge 241 of the opening and into the inner space of the guide housing 2, and the locking element 4 engages with the lowermost latching ramp 311 of the ramp row 31. Further movement of the displacement profile in the second direction 12 is blocked. The actuator device 1 is now in the latching position. A second end of the displacement path of the actuator device 1 is thus defined. The displacement profile 3 may be moved essentially exclusively in the first direction relative to the guide housing 2. The locking element 4 is rotated back and forth about the rotational axis during such a movement, and is always pushed by its spring tongue 42 into the next latching ramp 311 of the ramp row 31.

Figure 6:
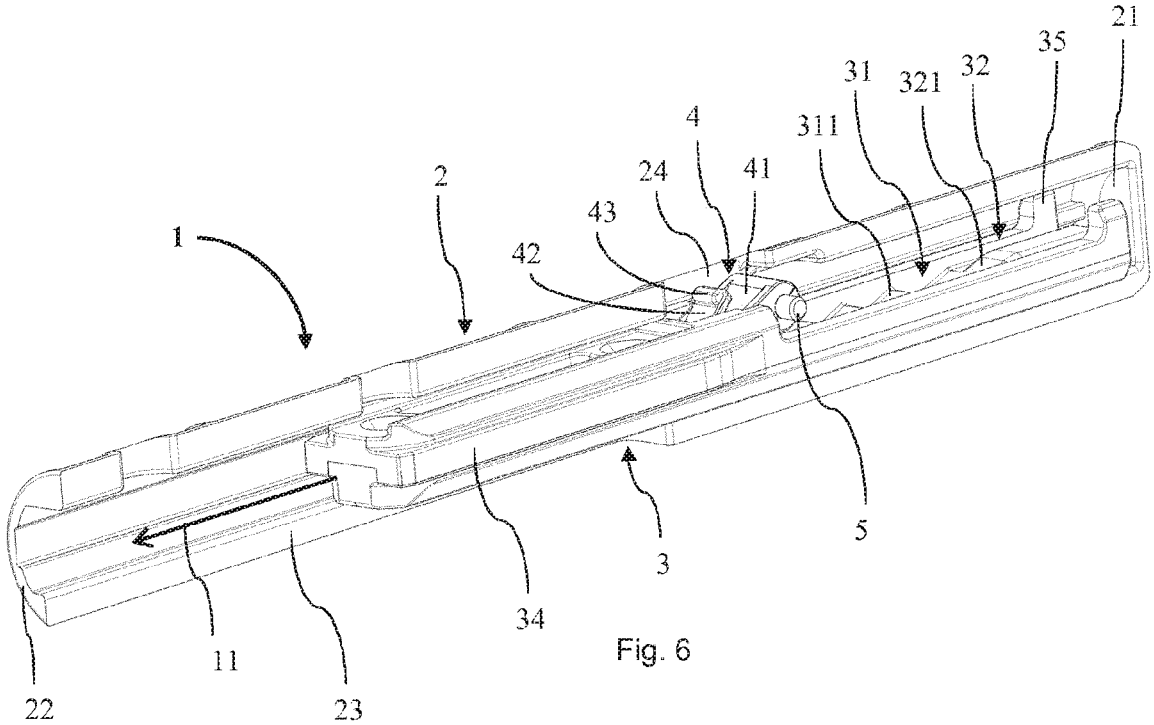
FIG. 6 shows another perspective view of the actuator device from FIG. 1, in which a housing half has been removed.

FIG. 6 shows the actuator device in a perspective view in which a housing half of the guide housing 2 is removed so that certain components are better visible. For example, it is clearly apparent from FIG. 6 that the stop 35 has a two-part design. In particular, the stop has two lateral projections, between which the abutment section of the deactivation ramp extends through.

When the actuator device 1 is used in a piece of seating furniture for adjusting the height of a backrest, the guide housing 2 is mounted on the backrest. The cylindrical guide housing 2 allows a certain lateral flexibility between the backrest and the guide housing 2. The displacement profile 3 is at the same time connected to a backrest carrier of the piece of seating furniture. In particular, the backrest carrier is mounted on the mounting section 34 of the displacement profile 3, which is easily possible through the slot 23 of the guide housing 3.

To adjust the backrest upwardly, a user of the seating furniture may easily pull the backrest up. The displacement profile 3 hereby moves in the first direction with respect to the guide housing 2. The locking element 4 in each case latches into the ramp row 31, so that the backrest may be adjusted in multiple discrete vertical positions or in a stepwise manner. To reduce the height of the backrest, it is pulled all the way to the top by the user. The locking element 4 is thus rotated into the retaining position, and the actuator device 1 is in the release position. The backrest may now be moved all the way down, where the locking element 4 is rotated out of the retaining position and once again interacts with the ramp row 31 of the displacement profile 3.

Figure 7:
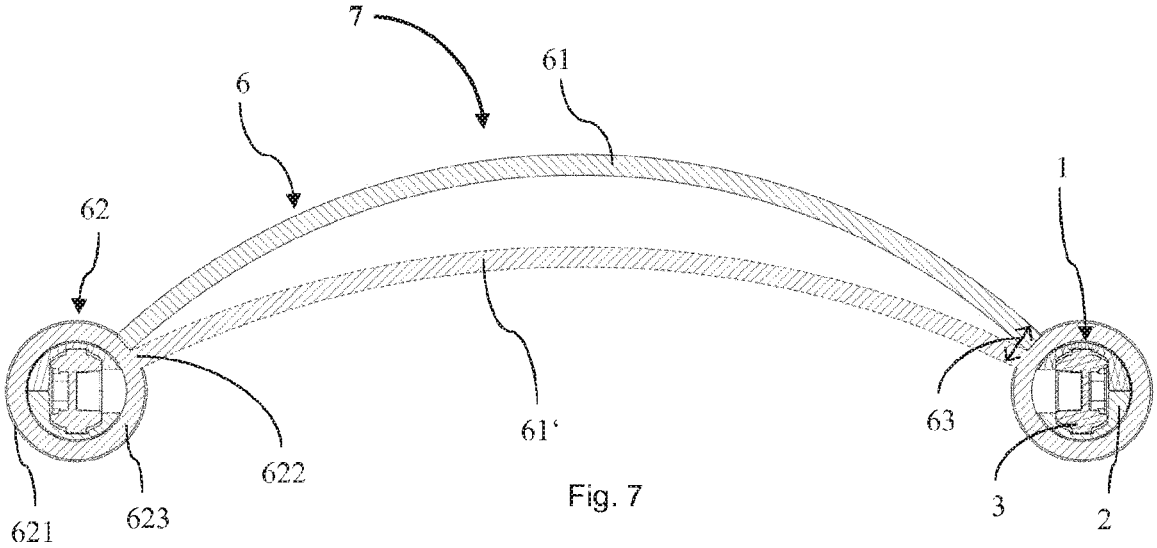
FIG. 7 shows a cross-sectional view of one exemplary embodiment of a backrest device according to the invention having two actuator devices according to FIG. 1.

FIG. 7 shows one exemplary embodiment of a backrest device 7 according to the invention, as installed in a chair according to the invention. The backrest device 7 includes a backrest 6 with a central support section 61, and two lateral brackets 62 or a left bracket 62 and a right further bracket 62. The two brackets 62 have analogous designs. They each include a casing 621 and a rotary cylinder 623 situated therein. The rotary cylinders 623 have a ring-shaped cross section, and each defines a hollow cylindrical inner space of the associated bracket 62.

An actuator device 1 is situated in flush alignment in each of the inner spaces of the brackets 62, as described above in conjunction with FIGS. 1 through 6. The backrest device 7 thus includes two actuator devices 1 or a left actuator device 1 and a right further actuator device 1. The inner spaces of the brackets 62 each define an inner surface whose shape corresponds to the outer circumference of the guide housing 2 of the associated actuator device 1.

The casings 621 of the brackets 62 are each fixedly connected to the guide housing 2 of the associated actuator device 1. The casings each have the shape of a slotted circular cylinder, the slot defining an opening 622. The support section 61 is fixedly connected to the rotary cylinders 623 through the openings 622 of the brackets 62. The rotary cylinders 623 of the brackets 62 are each rotatable about the guide housing 2 of the associated actuator device 1, and in the associated casing 621.

The support section 61 is shaped for supporting the back of a user of the chair. In particular, the support section has a curved or bent shape, viewed from above, for holding the back. In addition, the support section is made of an elastic material that allows the back to be flexibly held. Starting from a base position of the support section 61', the support section extends backward when the back leans against it, and gently absorbs the weight or the pressure of the back. Rotary cylinders 623 of the brackets 62, connected to the support section 61, hereby rotate about the guide housing 2 of the actuator devices 1 to the extent 63 defined by the openings 622. In particular, the left circular cylinder 623 thus rotates clockwise about the associated actuator device 1, and the right further circular cylinder 623 rotates counterclockwise about the associated further actuator device 1. The backrest device 7 may thus provide a preferred flexion that allows ergonomic support of the back.

When the support section 61 is relieved of load, due to its elasticity it moves back into the base position of the support section 61'. The rotary cylinders 623 of the brackets 62 are also rotated back about the guide housing 2 of the actuator devices 1 to the extent 63 defined by the openings 622.

The displacement profiles 3 of the actuator devices 1 are each fixedly connected to a backrest carrier of the chair. The backrest 6 may be adjusted with respect to the backrest carrier by means of the actuator devices 1. The height of the backrest 6 of the chair may thus be adapted to the user of the chair.

Although the invention is illustrated and described in detail by means of the figures and the associated description, respectively, this illustration and this detailed description are to be understood as illustrative and by way of example, and not as limiting to the invention. In certain cases, well-known structures and techniques may not be shown or described in detail so as not to overelaborate the invention. It is understood that experts in the field may make revisions and modifications without departing from the scope of the following claims. In particular, the present invention encompasses further exemplary embodiments with any combinations of features, which may differ from the feature combinations explicitly described.

The present disclosure also includes embodiments with any combination of features that are stated or shown in the preceding or subsequent discussion of various embodiments. The present disclosure likewise includes individual features in the figures, even if they are shown there in conjunction with other features, and/or are not mentioned in the preceding or subsequent discussion. In addition, the alternatives of embodiments and individual alternatives of their features that are described in the figures and in the description may be excluded from the subject matter of the invention or the disclosed subject matter. The disclosure includes embodiments that comprise only the features described in the claims or in the exemplary embodiments, as well as embodiments that comprise additional other features.

In addition, the expression "include" and derivations thereof does not exclude other elements or steps. Likewise, the indefinite article "a" or "an" does not exclude a plurality. The functions of multiple features stated in the claims may be met by one unit or one step. The terms "essentially," "approximately," "about," and the like in conjunction with a property or a value in particular also define the exact property or the exact value. The terms "approximately" and "about" in conjunction with a given numerical value or range may refer to a value or range that is within 20%, within 10%, within 5%, or within 2% of the given value or range.

The invention claimed is:

1. A backrest device for a piece of seating furniture comprising:

a backrest including a bracket;

a backrest carrier; and an actuator device that comprises, a guide housing having an essentially circular cylindrical outer circumference, a displacement profile that is situated in the guide housing and has a longitudinal axis, and a locking element, wherein the displacement profile or the guide housing includes a latching row that extends along the longitudinal axis and has a plurality of latching ramps, the locking element is resiliently supported, and in a latching position engages with the latching row so that the displacement profile is movable in a stepwise manner in a first direction along the longitudinal axis with respect to the guide housing, and a movement in a second direction, opposite the first direction, is blocked by the locking element striking against one of the latching ramps, the locking element is held, in a release position, in a disengaged state from the latching row, so that the displacement profile is freely movable in the first direction and in the second direction along the longitudinal axis with respect to the guide housing, the locking element is supported so that it is rotatable about a rotational axis, the locking element in the latching position is resiliently rotated about the rotational axis into the latching row, and preferably rotates back and forth about the rotational axis when the displacement profile moves in the first direction along the longitudinal axis with respect to the guide housing, and the locking element in the release position is held, while being rotated about the rotational axis into a retaining position, until it is disengaged from the latching row, and wherein the backrest is mounted on the guide housing of the actuator device, and the backrest carrier is mounted on the displacement profile of the actuator device, wherein the bracket of the backrest has an inner surface whose shape essentially corresponds to the outer circumference of the guide housing the actuator device, and wherein the actuator device is situated in the bracket of the backrest, so that the bracket of the backrest is rotatable about the guide housing of the actuator device.

2. The backrest device according to claim 1, wherein the bracket of the backrest includes a casing that is mounted so as to be nonrotatable with respect to the actuator device, and a rotary cylinder situated between the casing and the actuator device, the rotary cylinder being rotatable with respect to the casing and about the guide housing of the actuator device.

3. The backrest device according to claim 1, wherein the backrest has a further bracket and a support section that laterally merges into each of the two brackets, and a further actuator device that includes a guide housing having an essentially circular cylindrical outer circumference, situated in the further bracket of the backrest, whose guide housing is mounted on the backrest, and whose displacement profile is mounted on the backrest carrier.

4. The backrest device according to claim 3, wherein the bracket of the backrest has a further rotary cylinder, the two rotary cylinders being fixedly connected to the support section.

5. The backrest device according to claim 4, wherein the further bracket includes a further casing that is mounted so as to be nonrotatable with respect to the further actuator device, the further rotary cylinder being situated between the casing and the actuator device, and the further rotary cylinder being rotatable with respect to the further casing and about the guide housing of the further actuator device.

6. The backrest device according to claim 5, wherein the casing and the further casing each include an opening through which the rotary cylinder or the further rotary cylinder is connected to the support section, and wherein the openings in the casing and in the further casing specify an extent to which the rotary cylinder or the further rotary cylinder is rotatable about the guide housing of the actuator device or the guide housing of the further actuator device.

7. The backrest device according to claim 1, wherein in the actuator device the latching row is provided on the displacement profile, and the locking element is rotatably supported on the guide housing.

8. The backrest device according to claim 1, wherein in the actuator device the rotational axis is oriented transversely and in particular essentially at a right angle with respect to the longitudinal axis.

9. The backrest device according to claim 1, wherein in the actuator device the guide housing has a retaining structure that holds the locking element when it is rotated into the retaining position.

10. The backrest device according to claim 9, wherein in the actuator device the retaining structure of the guide housing includes an opening in which the locking element rests when it is rotated into the retaining position, the locking element resting against an edge of the opening of the guide housing in a frictionally engaged manner.

11. The backrest device according to claim 9, wherein in the actuator device the locking element has a clamping tab that cooperates with the retaining structure of the guide housing in the retaining position of the locking element.

12. The backrest device according to claim 1, wherein the actuator device further comprises a deactivation structure that rotates the locking element into the retaining position when the displacement profile is moved in the first direction toward one end of the predefined displacement path, along the longitudinal axis with respect to the guide housing.

13. The backrest device according to claim 12, wherein in the actuator device the latching row is provided on the displacement profile, and the locking element is rotatably supported on the guide housing, and wherein the deactivation structure has a deactivation ramp that is integrally formed on the displacement profile and along which the locking element can be pressed into the retaining position, and wherein the deactivation ramp preferably is situated adjacent to the latching row in the direction of the longitudinal axis.

14. The backrest device according to claim 1, wherein the actuator device further comprises an activation structure that rotates the locking element out of the retaining position when the displacement profile is moved in the second direction toward one end of the predefined displacement path, along the longitudinal axis with respect to the guide housing.

15. The backrest device according to claim 14, wherein in the actuator device the latching row is provided on the displacement profile, and the locking element is rotatably supported on the guide housing, and wherein the activation structure has an activation ramp that is integrally formed on the displacement profile and along which the locking element may be pressed into the retaining position.

16. The backrest device according to claim 15, wherein in the actuator device the guide housing has a retaining structure that holds the locking element when it is rotated into the retaining position, wherein the retaining structure of the guide housing includes an opening in which the locking element rests when it is rotated into the retaining position, the locking element resting against an edge of the opening of the guide housing in a frictionally engaged manner, and wherein the activation ramp is situated adjacent to the edge of the opening.

17. A chair, having a seat support, a seat that is mounted on the seat support, and a backrest device according to claim 1, wherein the backrest carrier is situated on the seat support.

* * * * *